US005921686A

United States Patent [19]

Baird et al.

[11] Patent Number: 5,921,686

[45] **Date of Patent: *Jul. 13, 1999**

[54] KIOSK PRINTER

[75] Inventors: David J. Baird, Clinton; Xianming Fang, Brighton; Eric J. Peterson, Chelmsford, all of Mass.

[73] Assignee: Telpar, Inc., Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/784,758

[22] Filed: Jan. 16, 1997

[51] Int. Cl.[6] ..... B41J 5/30

[52] U.S. Cl. ..... 400/68; 101/227

[58] Field of Search ..... 400/68, 621, 708; 101/227, 228, 484

[56] References Cited

U.S. PATENT DOCUMENTS

| | | | |
|---|---|---|---|
| 3,957,173 | 5/1976 | Roudebush | 221/15 |
| 4,192,618 | 3/1980 | Kondur, Jr. et al. | 400/124 |
| 4,319,132 | 3/1982 | Guiborg et al. | 235/379 |
| 4,340,150 | 7/1982 | Guiborg et al. | 221/21 |
| 4,619,197 | 10/1986 | Pailler | 101/93.04 |
| 4,792,131 | 12/1988 | Akiyama | 400/708 |
| 4,834,568 | 5/1989 | Kagami | 400/708 |
| 5,071,273 | 12/1991 | Kato | 400/708 |
| 5,133,611 | 7/1992 | Nakajima | 400/708 |
| 5,215,393 | 6/1993 | Wincent | 400/621 |
| 5,335,484 | 8/1994 | Hain | 53/582 |
| 5,349,534 | 9/1994 | Rousseff et al. | 364/479 |
| 5,478,161 | 12/1995 | Suzuki et al. | 400/582 |
| 5,588,762 | 12/1996 | Suzuki | 400/708 |

*Primary Examiner*—Edgar Burr
*Assistant Examiner*—Charles H. Nolan, Jr.
*Attorney, Agent, or Firm*—Jenner & Block

[57] ABSTRACT

The invention provides a microprocessor controlled kiosk printer with a communication interface to a remote host for printing documents, such as receipts and tickets. The printer includes a printer mechanism and an idler roller and a drive roller in engagement for gripping the document. The drive roller is under the control of the microprocessor. Guide plates are provided which, together with the controlled drive roller, prevent access to the document during printing. The controlled drive roller also provides for retracting the document.

27 Claims, 2 Drawing Sheets

KIOSK PRINTER

BACKGROUND OF THE INVENTION

1. Field of the Invention

The present invention relates to a printer for printing documents. More particularly, the present invention relates to a kiosk printer having a communication link to a remote host computer for printing documents such as receipts and tickets.

2. Description of Related Art

Parking meters, gasoline pumps, cash-dispensers and many similar machines are often provided with devices which print information on a receipt, ticket, or other such document and then feed it to a customer who keeps it as verification of the service rendered or article purchased.

Wincent, U.S. Pat. No. 5,215,393, discloses a device which does not feed documents to the customer until they are completely printed and cut. The printing device includes roller which feeds the document as it is being printed through a bracket wherein a cutting blade is mounted and thereafter through a series of guide plates so that it reaches the nip between upper and lower output rollers where it is gripped therebetween. At this point, a housing surrounding the device with only a narrow outlet opening therein prevents the customer from having access to the document. When the printing process is concluded, the cutting blade cuts the document and the pair of output rollers feeds the printed document through the outlet opening to the customer. Furthermore, if the outlet opening is blocked so that the printed document is unable to emerge therefrom, then the continued rotation of the lower output roller in the same direction tends draw the printed document back into the device where it is disposed of. In this way, a blocked outlet opening will not cause a jam.

It is well known that these printing devices have a number of problems associated with them. Sometimes the devices will fail because the customer tries to remove the receipt from the device before it has been completely printed. Another problem occurs when a customer fails to take the printed receipt. The next customer may simply throw away the prior unclaimed receipt in the vicinity of the device, thereby causing a litter problem. Another possibility is that the next time a receipt is printed the device may jam because of the presence of the prior receipt. In the event the printer jams, it may require costly repairs. Still another problem with unclaimed receipts is that the document itself may be valuable or contain confidential information such that it is undesirable to allow other customers to have access to it. Some, but not all, of these problems are addressed in the prior art.

SUMMARY OF THE INVENTION

Accordingly, it is an object of the present invention to overcome the problems associated with the prior art.

It is a further object to provide a printer which prints receipts, tickets, and other documents and dispenses same in a variety of different orientations.

It is a further object of the present invention to prevent customer access to the document until it is completed.

Still another object of the invention is to retract and dispose of any documents which are not taken by the customer.

Another object of the present invention is to provide electronic indications, such as to a remote host, of the status of the device, such as whether the customer has taken the document, whether the device is jammed, that the paper supply is low or out, and the status of the buffer.

In accordance with the present invention, a printer is provided, comprising, means for printing a document, means for presenting the document, and means for retracting the document.

The invention also provides a system having a microprocessor controlled kiosk printer with a communication interface coupled to a remote host, the system having means for printing a document, means for preventing access to the document, means for two-way communication with the remote host, said two-way communication means including means for communicating printer status to the remote host, and means for retracting the document.

DETAILED DESCRIPTION OF THE PREFERRED EMBODIMENT

Figure 1:
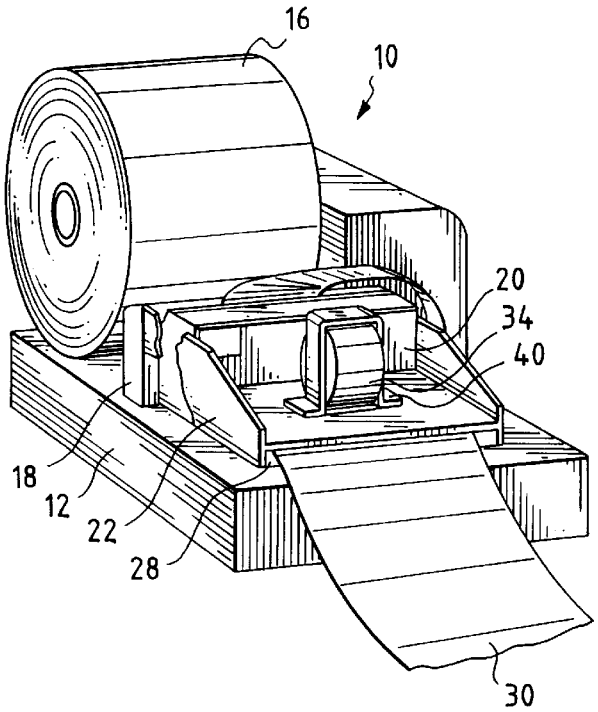
FIG. 1 is a perspective view of the device of the present invention.
Figure 2:
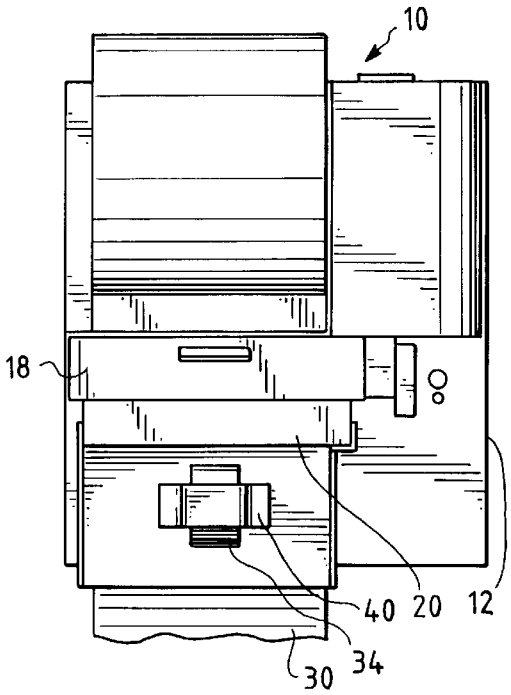
FIG. 2 is a top plan view of the device of FIG. 1.
Figure 3:
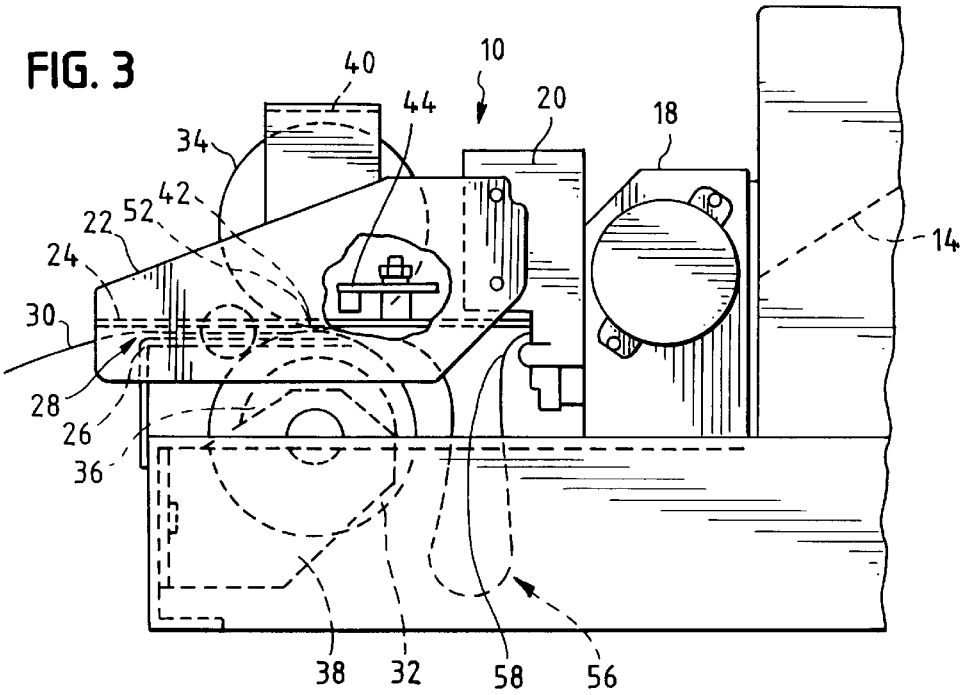
FIG. 3 is a side view of the device of FIG. 1.

The device 10 shown in FIGS. 1, 2, and 3 is a unit which is intended to be mounted on or in a gasoline pump, parking meter, cash-dispenser or any other machine which requires documents to be printed and dispensed to a customer. A base 12 is provided on which the components of the device 10 are mounted. The shape of base 12 can be adapted to fit the particular application of the present device. The device operates on a supply of paper 14, preferably in the form of a continuous strip which is wound in a roll 16.

A printer mechanism 18 is mounted in front of roll 16. Printer mechanism 18 is a compact electronically-controlled printer, of which many types are known in the art, having a printing head (not shown) which marks the paper and having appropriate means (not shown) to draw and guide the paper past the printing head. In the preferred embodiment, a direct thermal printing head is used.

Located in front of printer mechanism 18 is paper cutter 20. Paper cutter 20 can be any compact electronically-operated device having a blade or other means (not shown) for cutting paper 14, of which many types are known in the art. In the preferred embodiment, paper cutter 20 is a microprocessor controlled guillotine paper cutter.

In front of paper cutter 20 is document delivery chute 22 which features an upper guide plate 24 and a lower guide plate 26 arranged in a parallel configuration so as to define a narrow space therebetween adapted to allow paper 14 to pass through. The front edges of guide plates 24 and 26 define a narrow delivery opening 28 through which the completed document 30 is dispensed. Delivery opening 28 is only slightly larger than paper 14 so as to prevent other objects such as fingers from being able to enter the device.

A pair of rollers 32 and 34 are provided, each having a high-friction surface thereon so as to allow rollers 32 and 34 to tightly grip paper 14. Roller 32 is connected to and driven by delivery drive motor 36, which is mounted to base 12 via mounting bracket 38. Drive motor 36 can be any compact electronically-controlled electric motor that can provide torque in either direction. Roller 34 is rotatably mounted to mounting bracket 40, which in turn is attached to delivery chute 22. The surface of roller 34 is in contact with the surface of roller 32, which point of contact defines nip 42, so that when roller 32 is rotated by drive motor 36, roller 34 is also caused to rotate.

Paper sensor 44 is mounted on delivery chute 22. Paper sensor 44 produces a signal indicative of whether paper is present at a given location. In the preferred embodiment, paper sensor 44 is an optical sensor located slightly behind nip 42 so as to be able to sense whether paper is present at that location. Alternatively, the paper sensor is an electronic switch mechanically activated.

Figure 4:
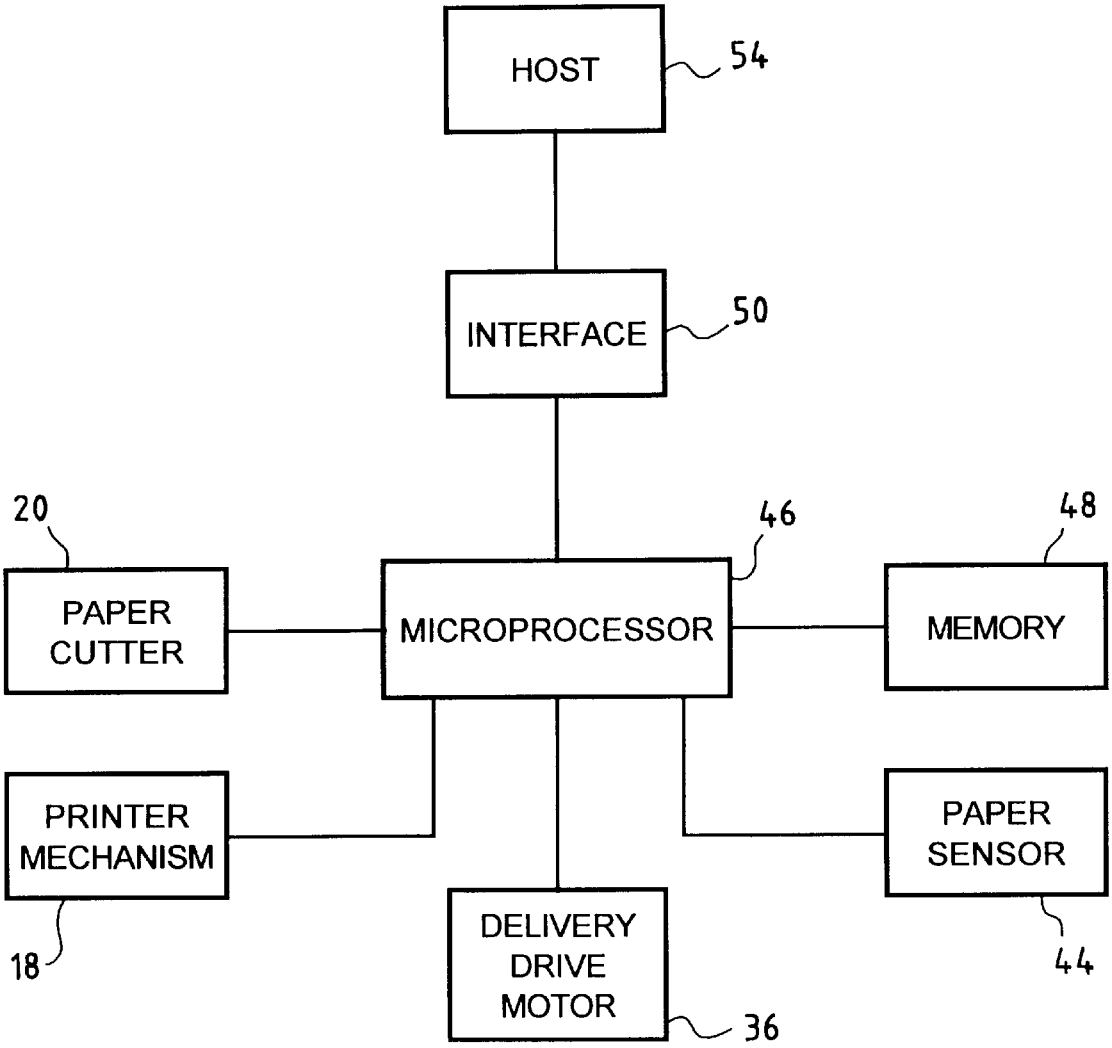
FIG. 4 is a block diagram of the control and communication system of the device of FIG. 1.

FIG. 4 shows schematically the electronic control and communication system of the device. Mounted on the device is microprocessor 46 for which is provided memory 48 and interface 50. The microprocessor 46 controls printer mechanism 18, paper cutter 20, and delivery drive motor 36, and receives signals from paper sensor 44. Interface 50 can be a serial RS-232C, or any other device allowing for two-way exchange of digital signals.

At the beginning of a printing operation, paper 14 extends from roll 16 to printer mechanism 18, wherein the leading edge 52 of a document is held. A printing operation is initiated by signals received by microprocessor 46 via interface 50 from a remote computer or host 54. The data to be printed is presented in digital form and sent by the remote computer 54 to the device via interface 50. Microprocessor 46 transfers the data to printer mechanism 18, using memory 48 as a buffer.

As printer mechanism 18 prints the data onto paper 14, printer mechanism 18 also feeds paper 14 therethrough toward the front of the device 10. Paper 14 is fed through paper cutter 20 until the leading edge 52 of paper 14 reaches nip 42, whereat paper 14 is gripped by rollers 32 and 34. At that point, the leading edge of paper 14 can move forward no further, so that paper 14 as it continues to be fed drapes downward to form bow configuration 56. Paper 14 is held in this bow configuration 56, wherein the leading edge 52 of paper 14 does not extend in front of nip 42, until the document is completed. At that time, paper 14 is substantially surrounded by delivery chute 22, base 12, and the other components of the device 10 so that the customer cannot access paper 14.

When all of the data is printed, microprocessor 46 sends a signal to paper cutter 20, causing it to cut paper 14. When the document is completely prepared, microprocessor 46 then causes motor drive 36 to rotate roller 32, which also rotates roller 34 and draws paper 14 forward. Paper 14, gripped between rollers 32 and 34, is fed between guide plates 24 and 26 to emerge from delivery opening 28 as completed document 30 available to the customer.

Microprocessor 46 stops the rotation of drive motor 36 when the completed document 30 is in the desired position. In this position, the leading edge 52 of document 30 protrudes from the device so as to be available to the customer, while the trailing edge 58 of document 30 is gripped between rollers 32 and 34 and is sensed by paper sensor 44. In this configuration, the dispensed document 30 is held in place by rollers 32 and 34 so that it can be dispensed in a variety of orientations without falling. However, the customer is still able to pull document 30 from the device by pulling it from between rollers 32 and 34.

It is preferable that when the customer removes completed document 30, paper sensor 44 sends a signal to microprocessor 46 indicating that the paper is no longer present. Microprocessor 46 then sends a signal via interface 50 to the remote computer (not shown) that the customer has taken the dispensed document 10.

If the customer does not take the dispensed document 30, then the device 10 can retract and dispose of document 30 in the following way. Microprocessor 44 causes drive motor 32 to rotate in the direction opposite to that used for dispensing document 30. Rollers 32 and 34 are thereby caused to rotate, drawing document 30 back into the device between guide plates 24 and 26. As the front edge of document 30 passes nip 42, it is no longer gripped by rollers 32 and 34 and falls behind roller 32. A collection bin (not shown) can be provided to catch documents retracted and disposed of in this way so as to prevent the area near the device from becoming littered.

Preferably, the microprocessor 46 determines via paper sensor 44 whether an unclaimed document 30 is present whenever it receives the next print command. If an unclaimed document is sensed, then microprocessor 46 causes the device to retract and dispose of the unclaimed document before printing the next document.

We claim:

1. A kiosk printer for printing and processing a document from a continuous roll of paper comprising:

means for printing information on the document and feeding the document downstream;

cutting means for separating the document from the continuous roll after said printing and feeding means has completed printing information on the document;

roller means for receiving the document from said cutting means and for delivering and discharging the document, whereby said roller means engages the document before said cutting means separates the document from the continuous roll;

sensor means for detecting the document upstream from said roller means;

a delivery location;

a discharge location; and controlling means for activating and deactivating said printing and feeding means, said cutting means and said roller means, wherein said controlling means activates said roller means to feed the document to said delivery location after said cutting means has separated the document from the continuous roll, deactivates said roller means when said detecting means detects the trailing edge of the document and activates said roller means to retract and discharge the document to said discharge location if said sensor means detects the trailing edge of the document when said printing and feeding means is activated to print information on the next document and before the next document is printed.

2. The kiosk printer of claim 1, wherein said roller means includes drive motor means and engaging rollers.

3. The kiosk printer of claim 2, wherein said controlling means activates said drive motor means to rotate said engaging rollers in a first direction when said printing and feeding means is activated and deactivates said drive motor means when the leading edge of the document is detected by said sensor means, whereby said engaging rollers engage the leading edge of the document.

4. The kiosk printer of claim 3, wherein said controlling means activates said drive means to rotate said engaging rollers in said first direction when said cutting means has completed separating the document from the continuous roll, thereby feeding the document to said delivery location, and deactivates said drive means when the trailing edge of the document is detected by said sensor means.

5. The kiosk printer of claim 4, wherein said controlling means activates said drive means to rotate said engaging rollers in a second direction opposite to said first direction to retract and discharge the document to said discharge location if said sensor means detects the trailing edge of the document when said printing and feeding means is activated to print information on the next document.

6. The kiosk printer of claim 5, wherein said delivery location includes a lower guide plate and an upper guide plate forming a channel with a delivery opening located adjacent said engaging rollers.

7. A kiosk printer for printing and processing a document from a continuous roll of paper comprising:

means for printing information on the document;

cutting means for separating the document from the continuous roll after said printing means has completed printing information on the document;

roller means for receiving the document from said cutting means and for delivering and discharging the document, whereby said roller means engages the document before said cutting means separates the document from the continuous roll;

sensor means for detecting the document upstream from said roller means;

a delivery location;

a discharge location; and controlling means for activating and deactivating said printing means, said cutting means and said roller means, wherein said controlling means activates said roller means to feed the document to said delivery location after said cutting means has separated the document from the continuous roll, deactivates said roller means when said detecting means detects the trailing edge of the document and activates said roller means to retract and discharge the document to said discharge location if said sensor means detects the trailing edge of the document when said printing means is activated to print information on the next document and before the next document is printed.

8. The kiosk printer of claim 7, wherein said roller means includes drive motor means and engaging rollers.

9. The kiosk printer of claim 8, wherein said controlling means activates said drive motor means to rotate said engaging rollers in a first direction when said printing means is activated and deactivates said drive motor means when the leading edge of the document is detected by said sensor means, whereby said engaging rollers engage the leading edge of the document.

10. The kiosk printer of claim 8, wherein said controlling means activates said drive means to rotate said engaging rollers in said first direction when said cutting means has completed separating the document from the continuous roll, thereby feeding the document to said delivery location, and deactivates said drive means when the trailing edge of the document is detected by said sensor means.

11. The kiosk printer of claim 10, wherein said controlling means activates said drive means to rotate said engaging rollers in a second direction opposite to said first direction to retract and discharge the document to said discharge location if said sensor means detects the trailing edge of the document when said printing means is activated to print information on the next document.

12. The kiosk printer of claim 11, wherein said delivery location includes a lower guide plate and an upper guide plate forming a channel with a delivery opening located adjacent said engaging rollers.

13. A method for controlling the printing and processing of a document from a continuous roll of paper in a kiosk printer having a printer, a feeder, a paper cutter, a roller mechanism, a sensor positioned upstream from the roller mechanism, a delivery location and a discharge location comprising the steps of printing information on the document and feeding the document through the paper cutter to engage the roller mechanism, cutting the document from the continuous roll of paper after printing has been completed, delivering the document through the roller mechanism to the delivery location and, if the trailing edge of the document is detected by the sensor when the printer receives the next print command, retracting the document through the roller mechanism and discharging the document to the discharge location before commencing printing of the next document.

14. A system having a microprocessor controlled kiosk printer with a communication interface coupled to a remote host for printing and processing a document from a continuous roll of paper, the system comprising:

means for printing information on the document;

cutting means for separating the document from the continuous roll after said printing means has completed printing information on the document;

roller means for receiving the document from said cutting means and for delivering and discharging the document;

sensor means for detecting the document upstream from said roller means;

a delivery location;

a discharge location;

means for two-way communication with the remote host, said two-way communication means including means for communicating printing status to the remote host; and controlling means for activating and deactivating said printing means, said cutting means and said roller means, wherein said controlling means activates said roller means to deliver the document to said delivery location after said cutting means has separated the document from the continuous roll and activates said roller means to discharge the document to said discharge location if said sensor means detects the document when said printing means is activated to print information on the next document and before the next document is printed.

15. A kiosk printer for printing and processing a document from a continuous roll of paper comprising:

means for printing information on the document and feeding the document downstream;

cutting means for separating the document from the continuous roll after said printing and feeding means has completed printing information on the document;

roller means for receiving the document from said cutting means and for delivering and discharging the document, whereby said roller means engages the document before said cutting means separates the document from the continuous roll;

sensor means for detecting the document upstream from said roller means;

a delivery location;

a discharge location; and controlling means for activating and deactivating said printing and feeding means, said cutting means and said roller means, wherein said controlling means activates both said printing and feeding means and said roller means to initiate printing, deactivates said roller means to engage the document after said sensor means detects the leading edge of the document, activates said roller means to feed the document to said delivery location after said cutting means has separated the document from the continuous roll, deactivates said roller means when said sensor means detects the trailing edge of the document and activates said roller means to retract and discharge the document to said discharge location if said sensor means detects the trailing edge of the document when said printing and feeding means is activated to print information on the next document and before the next document is printed.

16. The kiosk printer of claim 15, wherein said roller means includes drive motor means and engaging rollers.

17. The kiosk printer of claim 16, wherein said controlling means activates said drive motor means to rotate said engaging rollers in a first direction when said printing and feeding means is activated and deactivates said drive motor means when the leading edge of the document is detected by said sensor means, whereby said engaging rollers engage the leading edge of the document.

18. The kiosk printer of claim 17 wherein said controlling means activates said drive means to rotate said engaging rollers in said first direction when said cutting means has completed separating the document from the continuous roll, thereby feeding the document to said delivery location, and deactivates said drive means when the trailing edge of the document is detected by said sensor means.

19. The kiosk printer of claim 18, wherein said controlling means activates said drive means to rotate said engaging rollers in a second direction opposite to said first direction to retract and discharge the document to said discharge location if said sensor means detects the trailing edge of the document when said printing and feeding means is activated to print information on the next document.

20. The kiosk printer of claim 19 wherein said delivery location includes a lower guide plate and an upper guide plate forming a channel with a delivery opening located adjacent said engaging rollers.

21. A kiosk printer for printing and processing a document from a continuous roll of paper comprising:

means for printing information on the document;

cutting means for separating the document from the continuous roll after said printing means has completed printing information on the document;

roller means for receiving the document from said cutting means and for delivering and discharging the document, whereby said roller means engages the document before said cutting means separates the document from the continuous roll;

sensor means for detecting the document upstream from said roller means;

a delivery location;

a discharge location; and controlling means for activating and deactivating said printing means, said cutting means and said roller means, wherein said controlling means activates both said printing and feeding means and said roller means to initiate printing, deactivates said roller means to engage the document after said sensor means detects the leading edge of the document, activates said roller means to feed the document to said delivery location after said cutting means has separated the document from the continuous roll, deactivates said roller means when said sensor means detects the trailing edge of the document and activates said roller means to retract and discharge the document to said discharge location if said sensor means detects the trailing edge of the document when said printing means is activated to print information on the next document and before the next document is printed.

22. The kiosk printer of claim 21, wherein said roller means includes drive motor means and engaging rollers.

23. The kiosk printer of claim 22, wherein said controlling means activates said drive motor means to rotate said engaging rollers in a first direction when said printing means is activated and deactivates said drive motor means when the leading edge of the document is detected by said sensor means, whereby said engaging rollers engage the leading edge of the document.

24. The kiosk printer of claim 23, wherein said controlling means activates said drive means to rotate said engaging rollers in said first direction when said cutting means has completed separating the document from the continuous roll, thereby feeding the document to said delivery location, and deactivates said drive means when the trailing edge of the document is detected by said sensor means.

25. The kiosk printer of claim 24 wherein said controlling means activates said drive means to rotate said engaging rollers in a second direction opposite to said first direction to retract and discharge the document to said discharge location if said sensor means detects the trailing edge of the document when said printing means is activated to print information on the next document.

26. The kiosk printer of claim 25 wherein said delivery location includes a lower guide plate and an upper guide plate forming a channel with a delivery opening located adjacent said engaging rollers.

27. A system having a microprocessor controlled kiosk printer with a communication interface coupled to a remote host for printing and processing a document from a continuous roll of paper, the system comprising:

means for printing information on the document;

cutting means for separating the document from the continuous roll after said printing means has completed printing information on the document;

roller means for receiving the document from said cutting means and for delivering and discharging the document;

sensor means for detecting the document upstream from said roller means;

a delivery location;

a discharge location;

means for two-way communication with the remote host, said two-way communication means including means for communicating printing status to the remote host; and controlling means for activating and deactivating said printing means, said cutting means and said roller means, wherein said controlling means activates both said printing and feeding means and said roller means to initiate printing, deactivates said roller means to engage the document after said sensor means detects the leading edge of the document, activates said roller means to deliver the document to said delivery location after said cutting means has separated the document from the continuous roll and activates said roller means to discharge the document to said discharge location if said sensor means detects the document when said printing means is activated to print information on the next document and before the next document is printed.

* * * * *